US009228333B1

(12) United States Patent
Schuster et al.

(10) Patent No.: US 9,228,333 B1
(45) Date of Patent: Jan. 5, 2016

(54) DUAL FLUSH HANDLE CONTROL

(75) Inventors: Michael J. Schuster, Joliet, IL (US); Douglas C. Saunders, Plainfield, IL (US); Duston E. A. Stutzman, Plainfield, IL (US)

(73) Assignee: DANCO, INC., Irving, TX (US)

( * ) Notice: Subject to any disclaimer, the term of this patent is extended or adjusted under 35 U.S.C. 154(b) by 965 days.

(21) Appl. No.: 13/302,924

(22) Filed: Nov. 22, 2011

(51) Int. Cl.
*E03D 5/00* (2006.01)

(52) U.S. Cl.
CPC ..... *E03D 5/00* (2013.01)

(58) Field of Classification Search
CPC ..... E03D 5/092
USPC ..... 4/300–486
See application file for complete search history.

(56) References Cited

U.S. PATENT DOCUMENTS

| | | | | |
|---|---|---|---|---|
| 4,305,163 | A * | 12/1981 | Raz | 4/325 |
| 4,750,220 | A | 6/1988 | Baumann | |
| 5,117,513 | A | 6/1992 | Burrowes | |
| 5,140,712 | A | 8/1992 | Wang-On | |
| 5,301,373 | A * | 4/1994 | Hull et al. | 4/325 |
| 5,375,268 | A | 12/1994 | Chen | |
| 5,396,665 | A | 3/1995 | Raz et al. | |
| 5,491,848 | A | 2/1996 | Wang | |
| 6,263,520 | B1 | 7/2001 | Song | |
| 7,062,801 | B2 | 6/2006 | Oliver | |
| 2007/0163034 | A1 * | 7/2007 | Ogen | 4/325 |
| 2010/0132104 | A1 | 6/2010 | Csiki | |
| 2011/0203042 | A1 * | 8/2011 | Roberts et al. | 4/415 |
| 2013/0191981 | A1 * | 8/2013 | Schuster et al. | 4/249 |

* cited by examiner

*Primary Examiner* — Lori Baker

(74) *Attorney, Agent, or Firm* — Thomas | Horstemeyer, LLP

(57) ABSTRACT

Disclosed are various embodiments for a dual flush handle system. A first handle lever is configured to rotate in a direction by a first predetermined angle of rotation to initiate a first flush of a toilet. A second handle lever is configured to rotate in the direction about a second predetermined angle of rotation to initiate a second flush of a toilet.

29 Claims, 20 Drawing Sheets

DUAL FLUSH HANDLE CONTROL

BACKGROUND

Most dual flush toilet systems are provided as a package including a dual flush assembly and activation device to initiate operation of the dual flush assembly in one of the dual flush modes. In many instances, the activation control may not be preferred by the customer.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
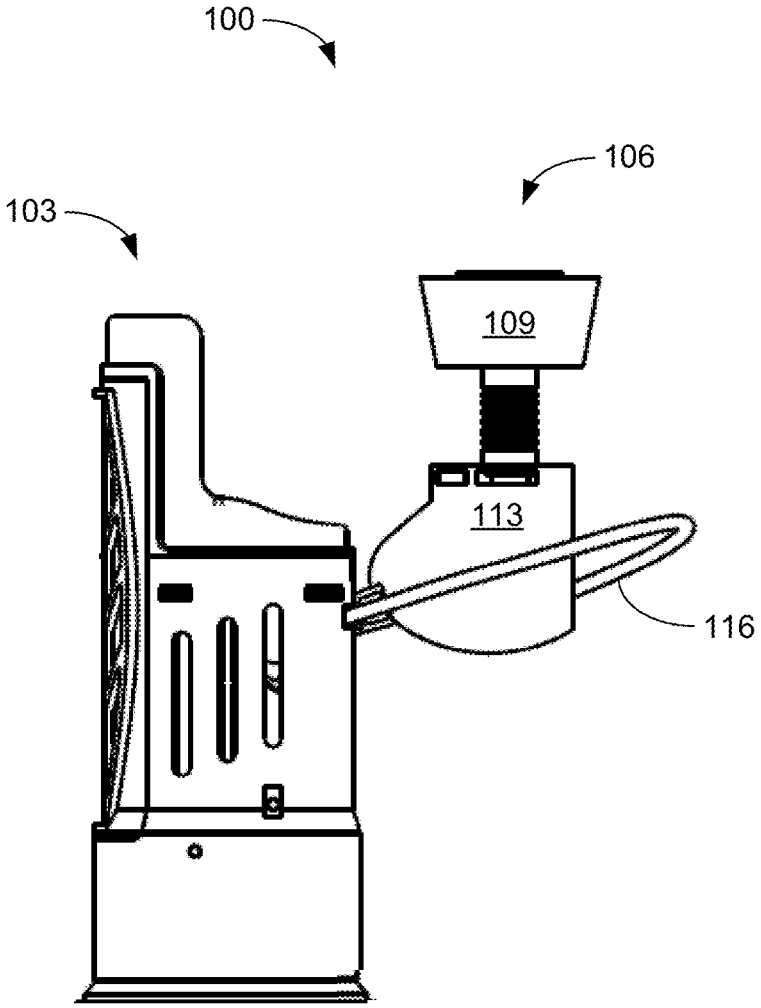
FIG. 1 is a drawing of a dual flush toilet system with push button activation of a dual flush assembly according to various embodiments of the disclosure.

With reference to FIG. 1, shown is a dual flush toilet system 100 including a dual flush assembly 103 and an activation assembly 106 to initiate operation of the dual flush assembly 103 in one of the dual flush modes: partial flush for liquids and full flush for solids. In the embodiment of FIG. 1, the activation assembly 106 includes a push button assembly 109 that is detachably connected to an actuation control box 113. The actuation control box 113 is in communication with the dual flush assembly 103 through a cable assembly 116, which is directly connected to the actuation control box 113 and the body of the dual flush assembly 103.

Referring next to FIGS. 2A-2F, the operation of the activation assembly 106 is illustrated. The push button assembly 109 is detachably connected to the actuation control box 113 through a shaft extension 203, which is threaded to mount the push button assembly 109 to the tank of the toilet with a nut.

In the embodiment of FIGS. 2A-2F, the end 206 of the shaft extension 203 is engaged with the actuation control box 113 by a spring-loaded clip assembly 209. By pressing the end of clip assembly 209, the push button assembly 109 may be detached from the actuation control box 113. The push button assembly 109 includes a first button 213 for activation of the quick flush mode with a reduced amount of water usage and a second button 216 for activation of the full flush mode using the standard amount of water.

Figure 2A:
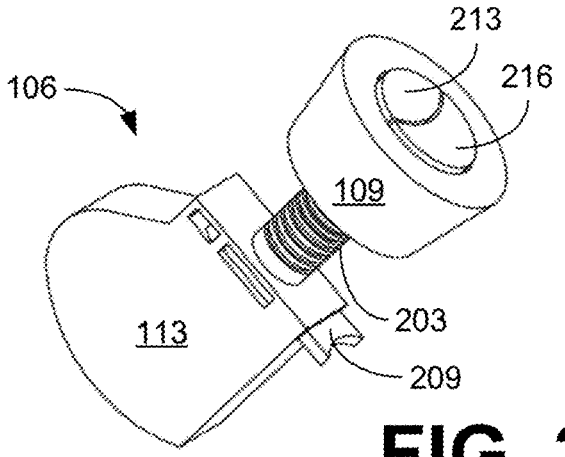
FIGS. 2A-2F are drawings that provide various views of an activation assembly for push button activation of the dual flush assembly of FIG. 1 according to various embodiments of the disclosure.
Figure 2B:
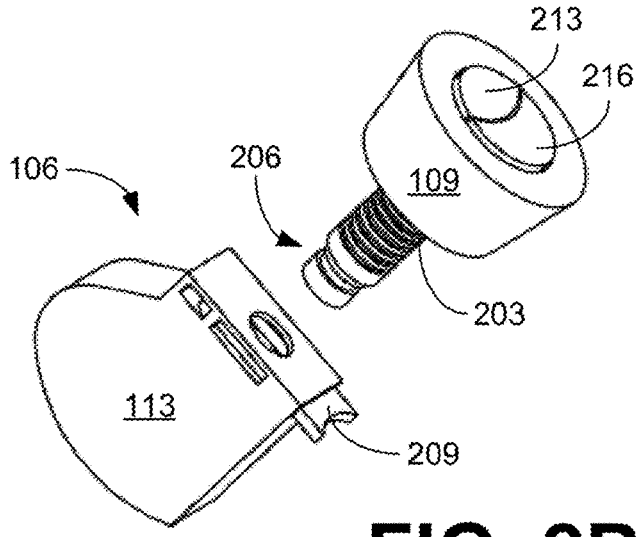
Figure 2C:
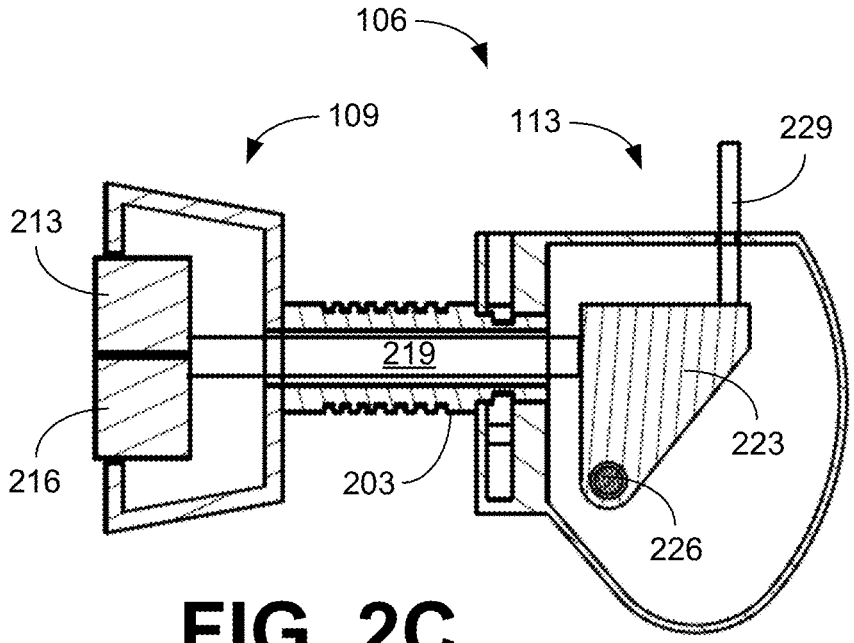
Figure 2D:
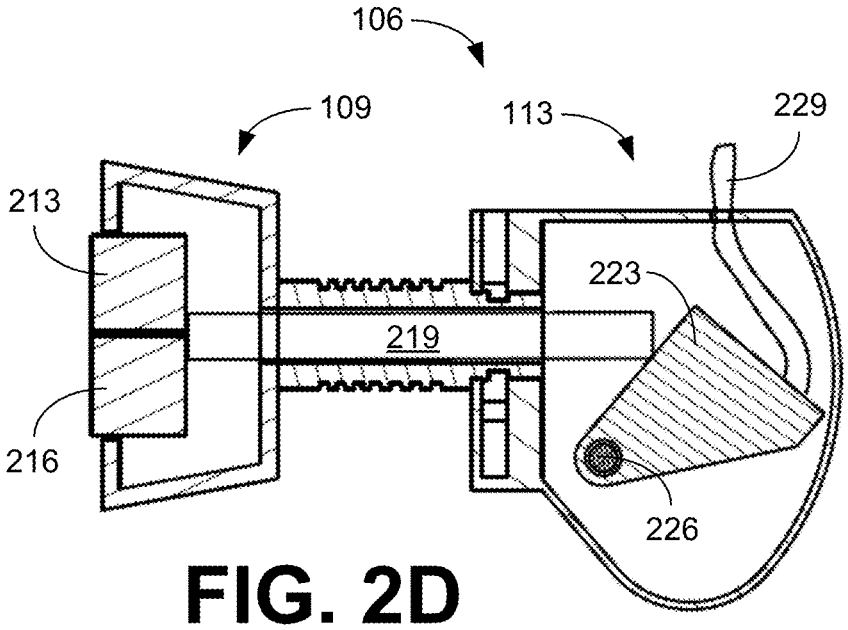
Figure 2E:
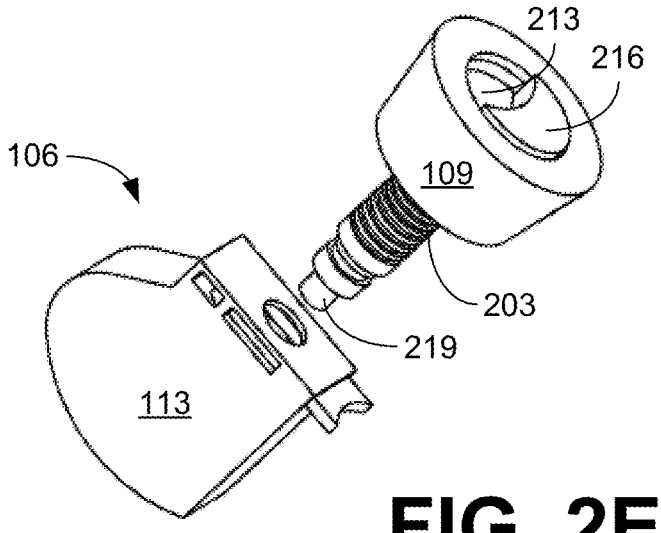
Figure 2F:
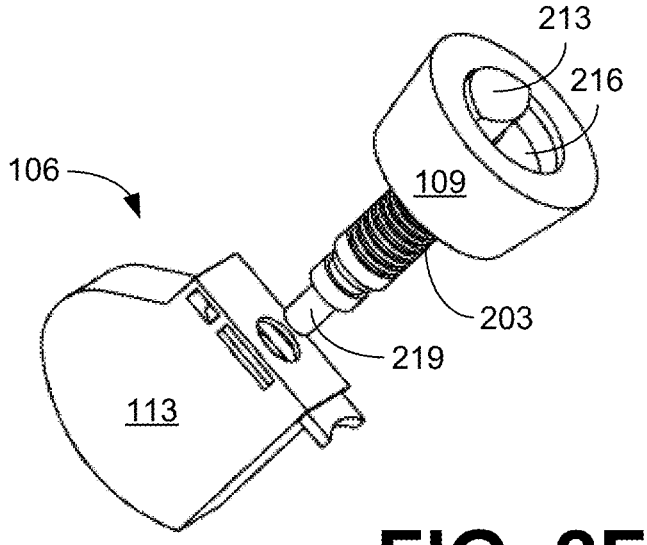

FIG. 2C illustrates a cross-sectional view of the activation assembly 106 of FIG. 2A. FIGS. 2A and 2C show the actuation control box 113 in a neutral position without buttons 213 or 216 depressed. Depressing one of the buttons 213 or 216 extends a plunger 219 from the end of the shaft extension 203 into the actuation control box 113. In the exemplary embodiment of FIGS. 2C-D, extension of plunger 219 causes a cam 223 to rotate about a fixed point 226, retracting a cable 229 into cable assembly 116 of FIG. 1. In this way, linear motion of the plunger 219 is converted into linear motion of cable 229 in cable assembly 116. Depressing the first "quick flush" button 213 extends the plunger 219 to a predetermined intermediate position as illustrated in FIG. 2E, while depressing the second "full flush" button 216 fully extends the plunger 219 as depicted in FIGS. 2B and 2F. When the plunger 219 is retracted after the desired flush is initiated, cam 223 and cable 229 return to the neutral position depicted in FIG. 2C.

Figure 3A:
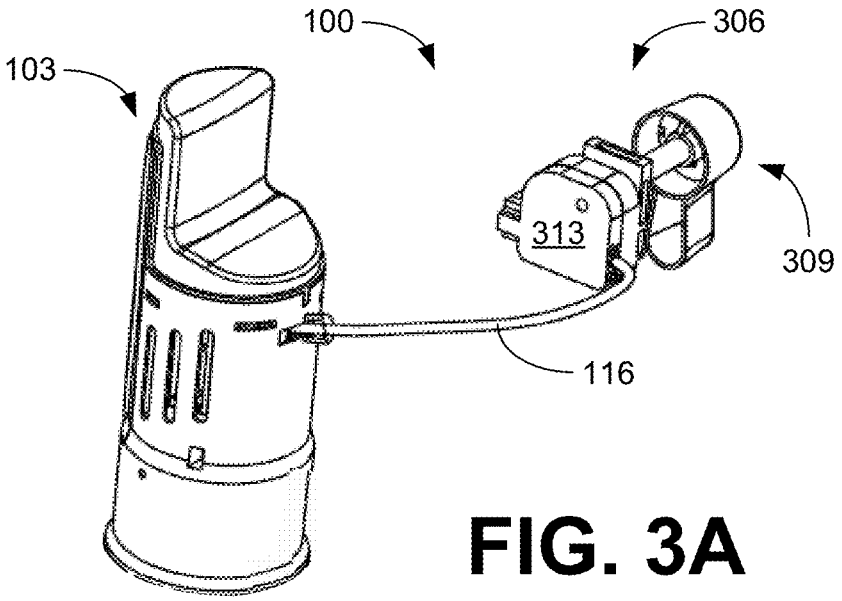
FIGS. 3A-3G are drawings of a dual flush toilet system with rotational activation of the dual flush assembly of FIG. 1 according to various embodiments of the disclosure.

With reference to FIGS. 3A-3G, shown is a dual flush toilet system 100 including a dual flush assembly 103 and an activation assembly 306 to initiate operation of the dual flush assembly 103 in one of the dual flush modes: quick flush for liquids and full flush for solids. In the embodiment of FIG. 3A, the activation assembly 306 includes a rotary handle assembly 309 that is detachably connected to an actuation control box 313. The exemplary actuation control box 313 is in communication with the dual flush assembly 103 through a cable assembly 116, which is connected to the actuation control box 313 and the body of the dual flush assembly 103.

Figure 3B:
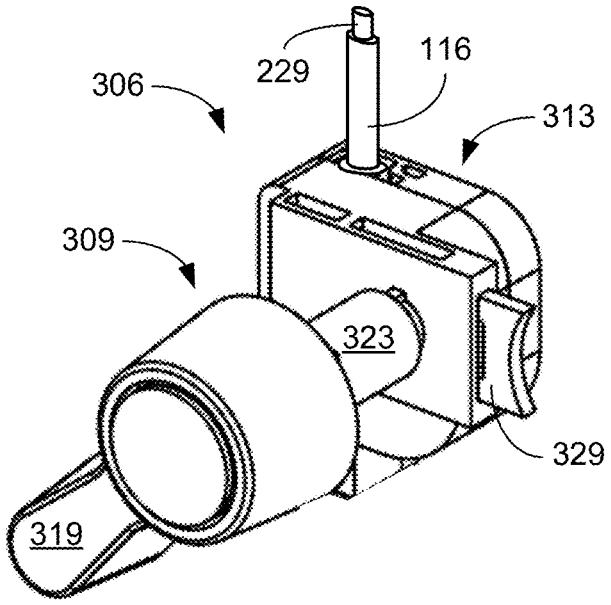

As illustrated in FIG. 3B, the rotary handle assembly 309 includes a handle lever 319, a mounting sleeve 323 and a shaft 326 (FIG. 3C), which extends through the mounting sleeve 323. The rotary handle assembly 309 is detachably connected to actuation control box 313. In the embodiment of FIGS. 3A-3G, the end of the mounting sleeve 323 is engaged with the actuation control box 313 by a spring-loaded clip assembly 329. By pressing the end of clip assembly 329, the rotary handle assembly 309 may be detached from the actuation control box 313.

Figure 3C:
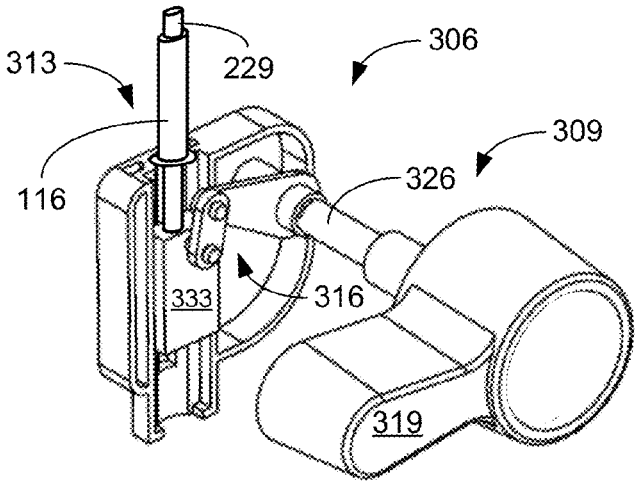

FIG. 3C provides a cross-sectional view of the actuation control box 313. Rotational motion of rotary handle assembly 309 is converted into linear motion of cable 229 in cable assembly 116 by the actuation control box 313 through linkage assembly 316 and piston 333, which is coupled to cable 229 and constrained within a guide channel. Full rotation of the rotary handle assembly 309 initiates a "full flush" of the dual flush assembly 103, while rotation of the rotary handle assembly 309 to only an intermediate position initiates a "quick flush" of the dual flush assembly 103. While the translation of rotational motion to linear motion by the exemplary actuation control box 313 is presented in terms of the linkage assembly 316 coupled to piston 333, other means for translation of rotational motion to linear motion may also be utilized within the actuation control box 313.

Figure 3D:
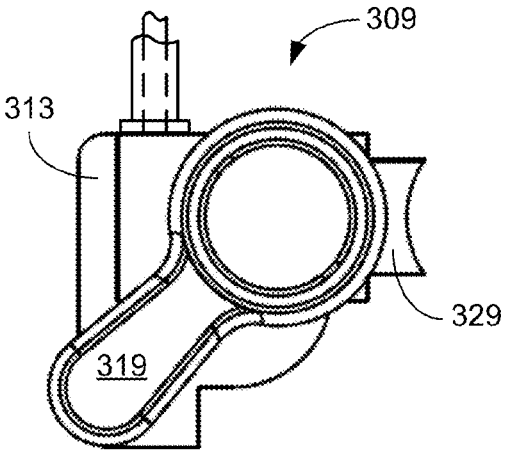
Figure 3E:
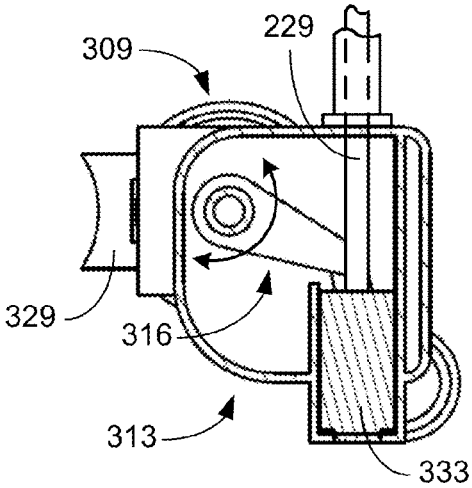

The operation of the exemplary activation assembly 306 with a rotary handle assembly 309 is now discussed with reference next to FIGS. 3D-3G. When the actuation control box 313 is in a neutral position (FIG. 3C), the handle lever 319 is in a horizontal position with cable 229 partially retracted into the actuation control box 313. Full rotation of the rotary handle assembly 309, as depicted in FIGS. 3D-3E, causes cable 229 to retract into the actuation control box 313, initiating a "full flush" of the dual flush assembly 103.

Figure 3F:
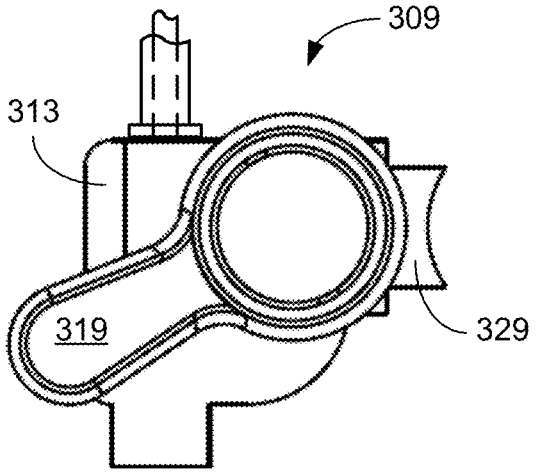
Figure 3G:
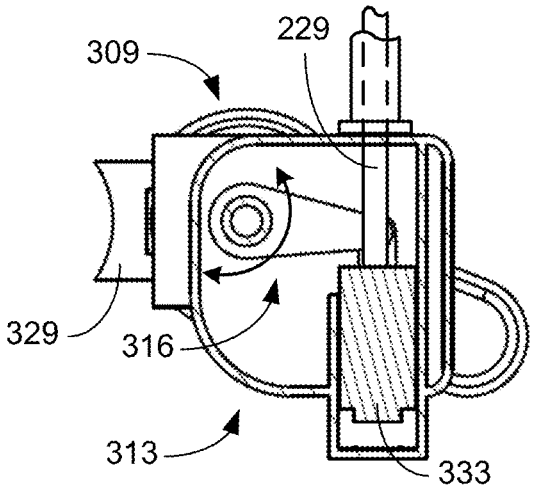

Restricting the rotation of rotary handle assembly 309, and thus retraction of cable 229, to an intermediate position provides for a "quick flush" of the dual flush assembly 103. FIGS. 3F-3G illustrate operation of the rotary handle assembly 309 with restricted rotation. As depicted in FIG. 3G, rotation of the handle lever 319 is translated from the shaft 326 through the linage assembly 316 and piston 333 to linear movement of cable 229 until the intermediate position is reached.

It is noted that, while the rotary handle assembly 309 is described in relation to an actuation control box 313, the rotary handle assembly 309 may be utilized in other applications that require a restricted rotational motion without the use of the actuation control box 313. For example, if a toilet utilizes a flapper that is lifted by a chain, the amount of flapper lift may be restricted by the rotary handle assembly 309. In one embodiment, a lever arm may engage with the end of the shaft 326 to lift the chain. Alternatively, rotation of the rotary handle assembly 309 may be sensed (either mechanically or electrically) to control an application.

Figure 4A:
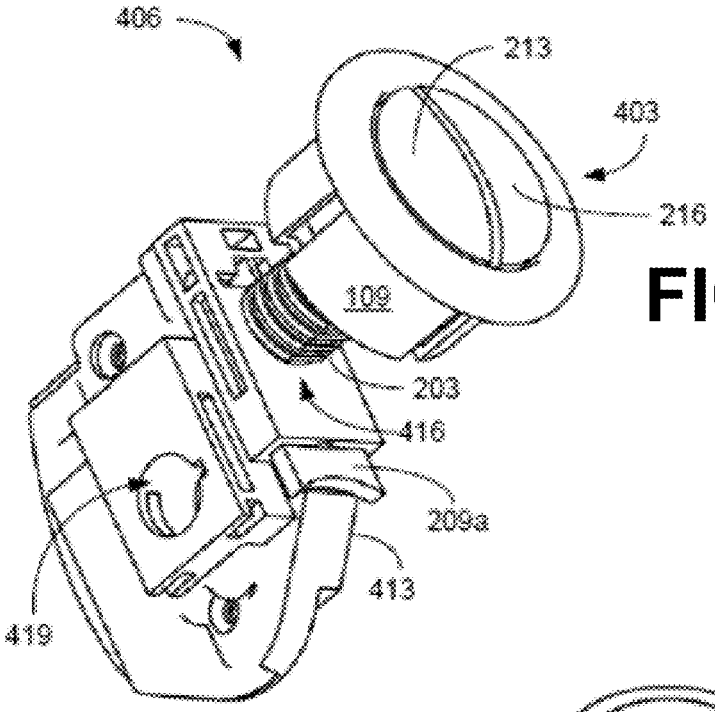
FIGS. 4A-4F are drawings of a dual-input activation assembly for use in the dual flush toilet system of FIG. 1 according to various embodiments of the disclosure.
Figure 4B:
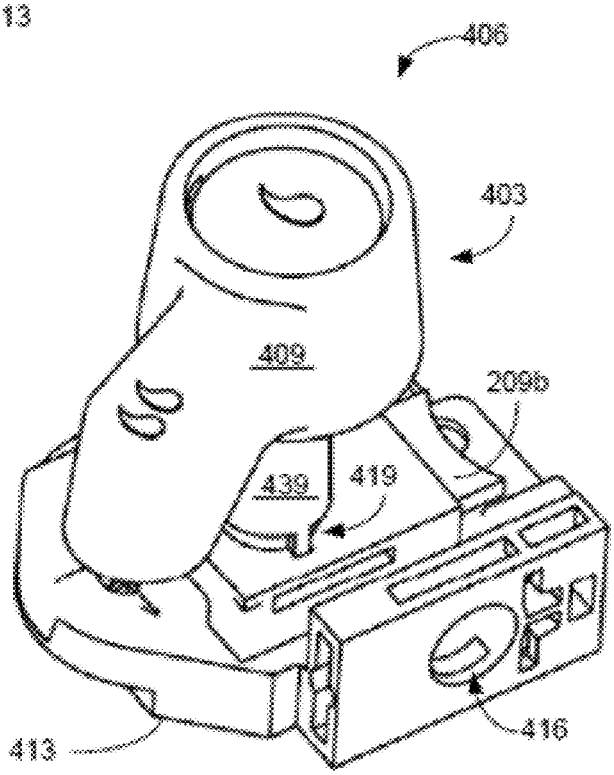
Figure 4C:
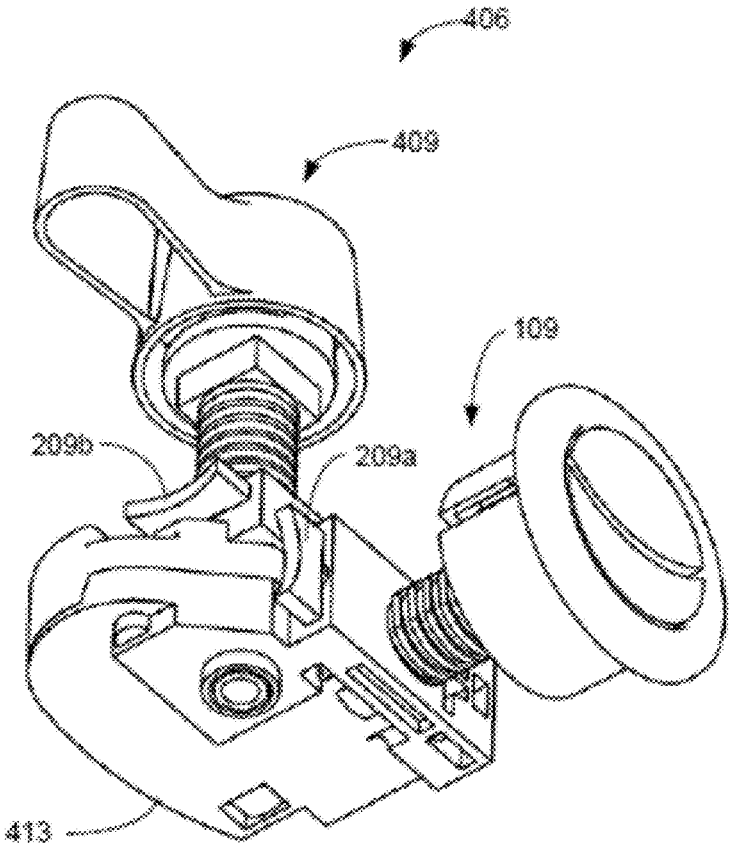

With reference to FIGS. 4A and 4B, shown is a dual-input activation assembly 406 that may be used in the dual flush toilet system 100 of FIG. 1 according to various embodiments of the disclosure. The dual-input activation assembly 406 includes an activation control assembly 403 detachably connected to a dual-input actuation control box 413. In the exemplary embodiment of FIG. 4A, the activation control assembly 403 is a push button assembly 109 detachably connected to the dual-input actuation control box 413 through a linear input connection 416. The push button assembly 109 includes the first button 213 for activation of the quick flush mode and the second button 216 for activation of the full flush mode. In a second configuration illustrated in FIG. 4B, the activation control assembly 403 is a rotary handle assembly 409 detachably connected to the dual-input actuation control box 413 through a rotational input connection 419. FIG. 4C illustrates dual-input activation assembly 406 with both a push button assembly 109 and a rotary handle assembly 409 detachably connected to the dual-input actuation control box 413.

Figure 4D:
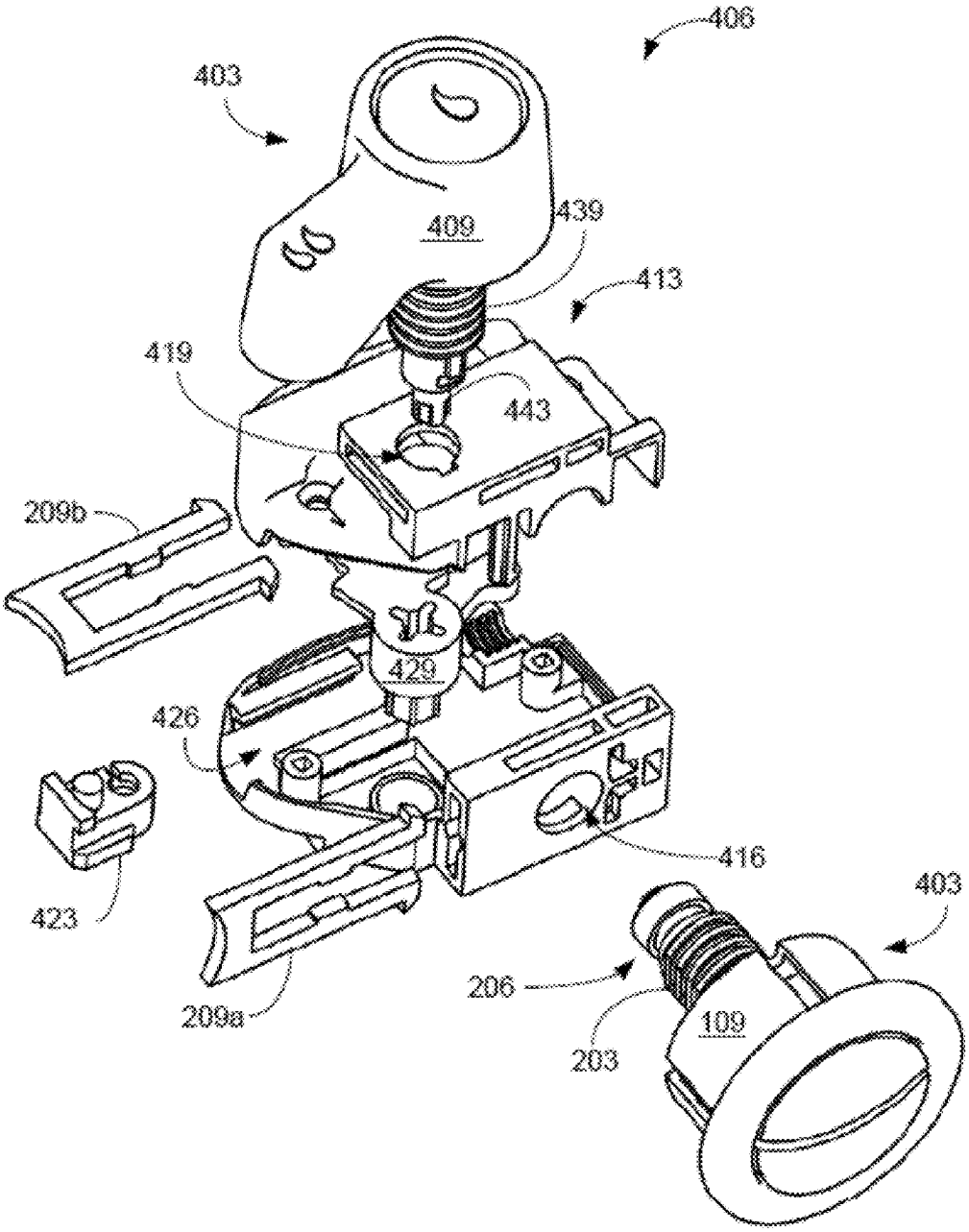

Referring now to FIG. 4D, shown is an exploded view of the dual-input activation assembly 406. The dual-input actuation control box 413 includes a cable anchor 423 that detachably connects one end of the cable 229 of cable assembly 116 (see e.g., FIGS. 5A-5G). Cable anchor 423 is constrained within the dual-input actuation control box 413 by a linear guide path 426. The dual-input actuation control box 413 also includes a dual-input cam 429 configured to translate activation motion of either the push button assembly 109 or the rotary handle assembly 409 into linear motion of the cable anchor 423, and thus an attached cable 229 in cable assembly 116. The dual-input actuation control box 413 is configured to allow the dual-input cam 429 to rotate about a rotational axis that is substantially perpendicular to the linear guide path 426.

The push button assembly 109 may be detachably connected to the dual-input actuation control box 413 through the linear input connection 416. In the embodiments of FIGS. 4A-4D, the end 206 of the shaft extension 203 of the push button assembly 109 is engaged with the push actuation control box 113 by a spring-loaded clip assembly 209*a*. By pressing the end of clip assembly 209*a*, the push button assembly 109 may be detached from the dual-input actuation control box 413.

Figure 4E:
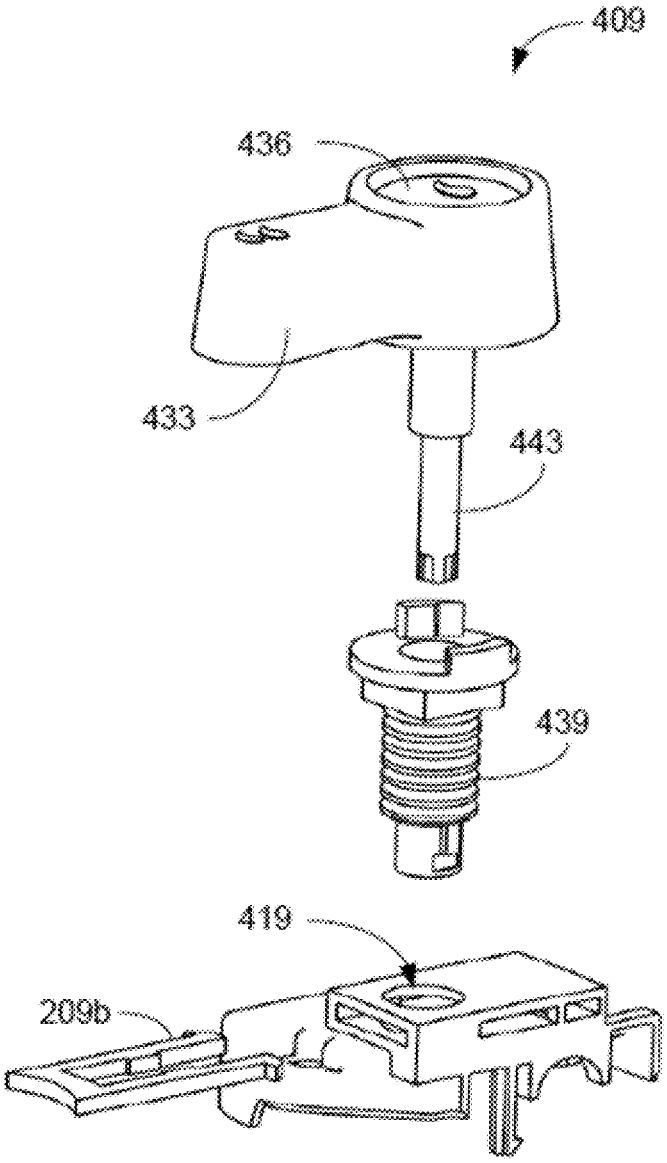
Figure 4F:
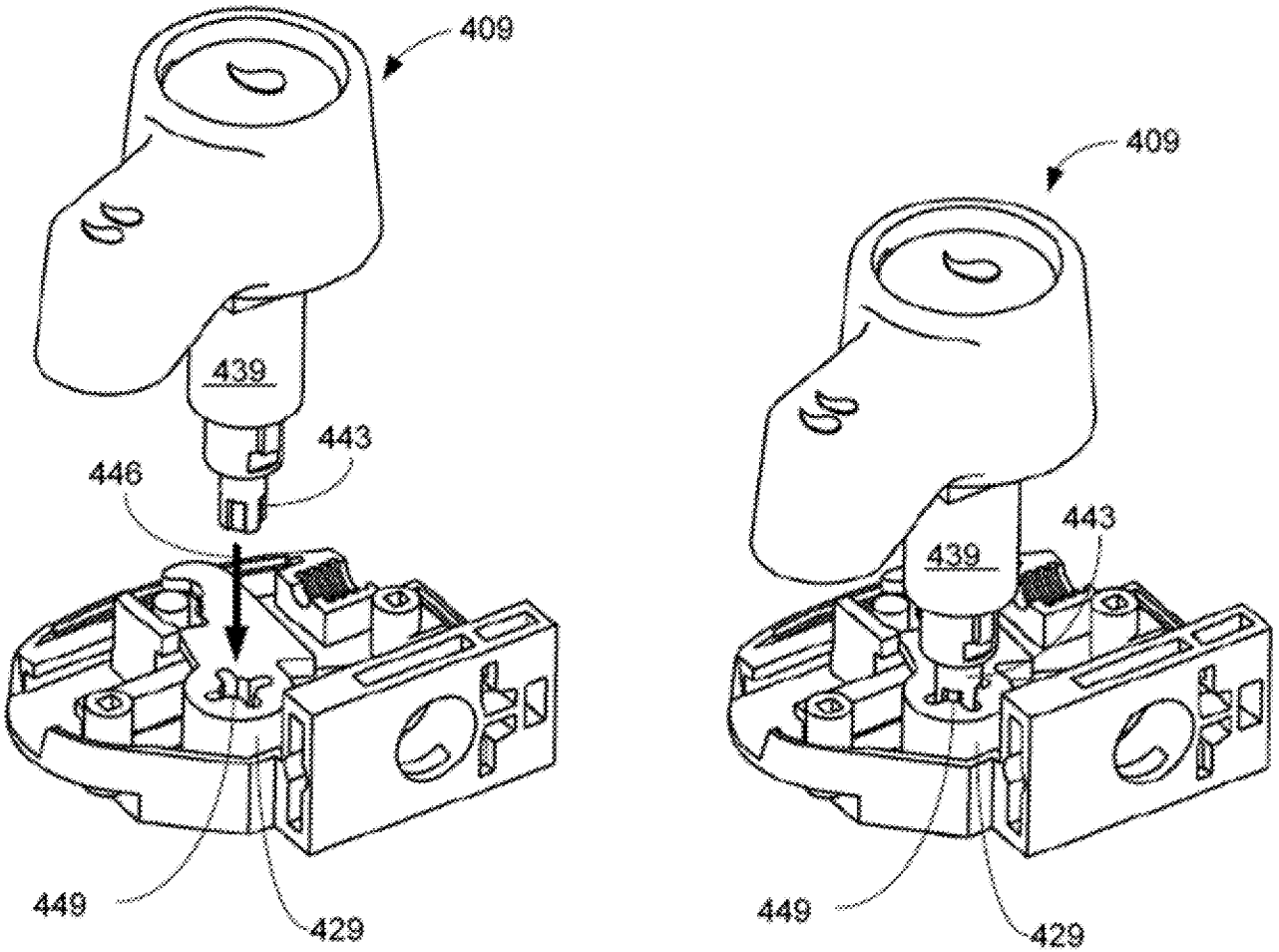

The rotary handle assembly 409 may also be detachably connected to the dual-input actuation control box 413 through a rotational input connection 419. Referring to FIG. 4E, shown is an exploded view of the rotary handle assembly 409. The rotary handle assembly 409 includes a handle lever 433, and may include a handle button 436 and a mounting sleeve 439 through which the shaft 443 of the handle lever 433 extends. In the embodiments of FIGS. 4A-4F, the end of the mounting sleeve 439 is engaged with the dual-input actuation control box 413 and may be detachably connected by a spring-loaded clip assembly 209*b* or other appropriate connection. By pressing the end of clip assembly 209*b*, the rotary handle assembly 409 may be detached from the dual-input actuation control box 413.

When detachably connected to the dual-input actuation control box 413, the rotary handle assembly 409 engages with dual-input cam 429. Referring now to FIG. 4E, as the rotary handle assembly 409 is inserted (depicted as arrow 446) through the rotational input connection 419 (FIGS. 4A-4E), the end of the handle shaft 443 engages with a corresponding opening 449 in the dual-input cam 429. In the embodiments of FIGS. 4A-4F, the end of the shaft 443 of the handle lever 433 includes a spline that aligns with opening 449 to provide for torque transfer to the dual-input cam 429. Other embodiments may utilize shaft end shapes such as, but not limited to, square, triangular, hexagonal, and keyed and a correspondingly shaped opening 449 in the dual-input cam 429.

Figure 5A:
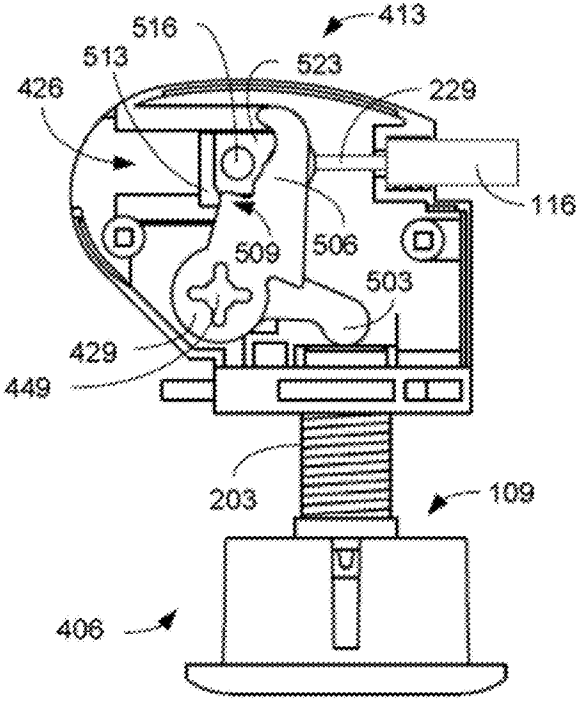
FIGS. 5A-5G are drawings that provide various views of the dual-input activation assembly of FIGS. 4A-4F according to various embodiments of the disclosure.
Figure 5B:
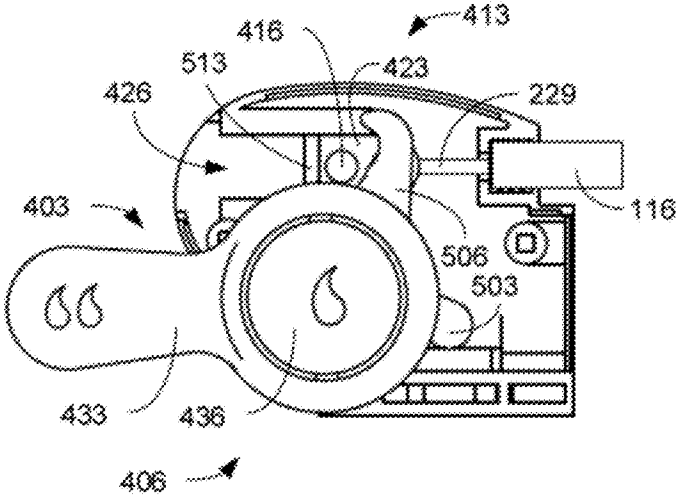
Figure 5C:
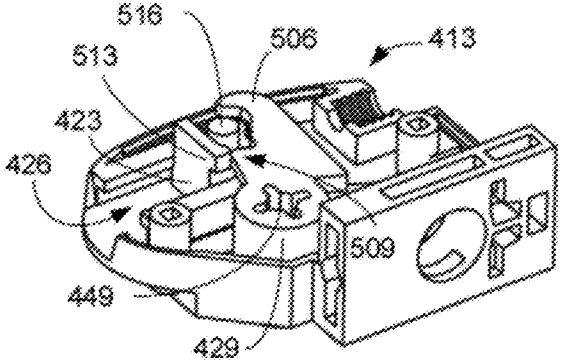

Next, operation of the dual-input activation assembly 406 is now discussed with reference next to FIGS. 5A-5G. FIGS. 5A-5C illustrate the dual-input activation assembly 406 in a neutral position. FIG. 5A depicts the dual-input actuation control box 413 in the neutral position without either the first button 213 (FIG. 4A) for activation of the quick flush mode or the second button 216 (FIG. 4A) for activation of the full flush mode depressed. In addition, when the dual-input actuation control box 413 is in a neutral position as depicted in FIG. 5B, the handle lever 433 is in a neutral position. In the embodiment of FIG. 5B, the handle lever 433 is in a horizontal position. FIG. 5C provides a cutaway view of the dual-input actuation control box 413 in the neutral position. In the neutral position, the cable 229 is retracted in cable assembly 116 and the cable anchor 423 is at a neutral position in the linear guide path 426.

Depressing one of the buttons 213 or 216 extends a plunger 219 (FIGS. 5D and 5F) from the end of the shaft extension 203 into the dual-input actuation control box 413. In the exemplary embodiments of FIGS. 5D and 5F, as the plunger 219 extends, the plunger 219 engages plunger arm 503 of the dual-input cam 429 causing the dual-input cam 429 to rotate about the rotational axis. The force provided through the plunger 219 is transferred through the dual-input cam 429 to the cable anchor 423 in the linear guide path 426 by an anchor arm 506. In the embodiments of FIGS. 5A-5G, the anchor arm 506 is configured to exert an initial breakaway force on the cable anchor 423, followed by a reduced translation force. In one embodiment, the higher breakaway force is exerted at a breakaway point 509 of the anchor arm 506 on a breakaway shoulder 513 of the cable anchor 423. As the cable anchor 423 moves along the linear guide path 426, the dual-input cam 429 rotates about the rotational axis until the anchor arm 506 engages a translation pin 516 at a second position on the anchor arm 506.

Further rotation of the dual-input cam 429 exerts a reduced translation force on the cable anchor 423 though the translation pin 516 because of an increased lever arm length. Anchor arm 506 disengages with the breakaway shoulder 513, removing the breakaway force from the cable anchor 423.

Figure 5D:
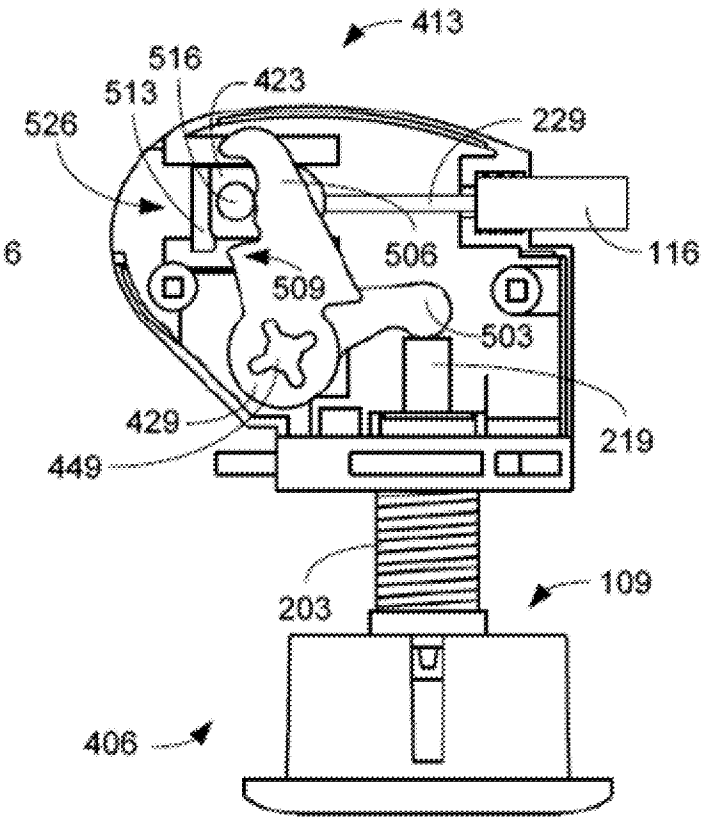
Figure 5E:
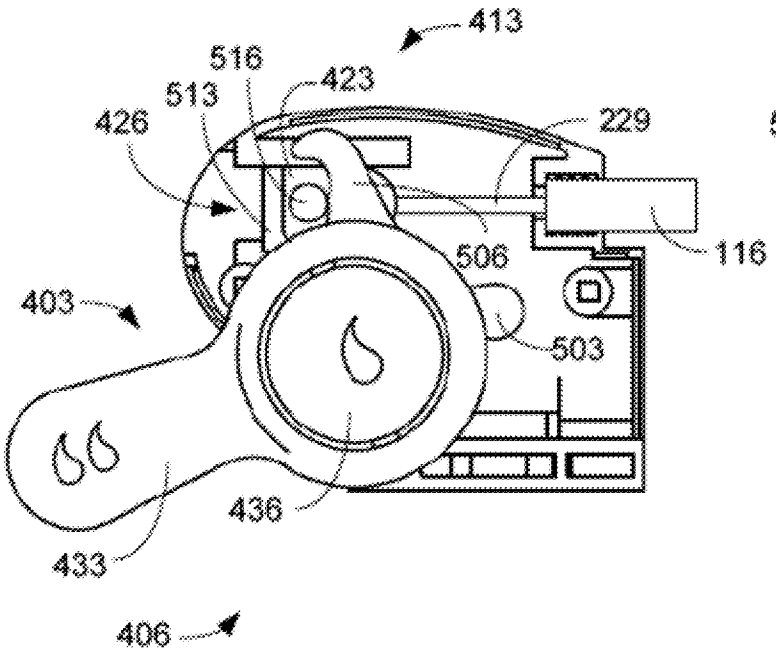
Figure 5F:
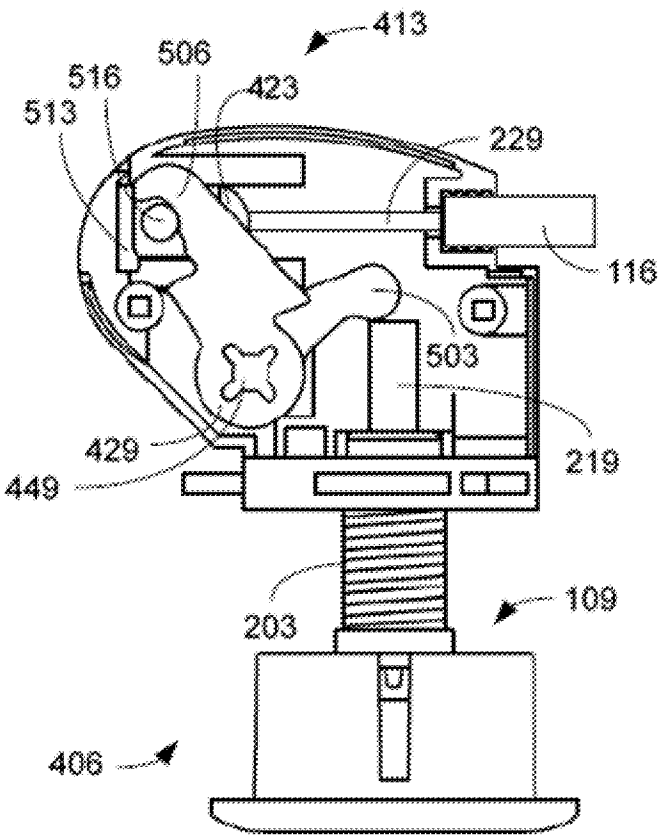

Depressing the quick flush button 213 (FIG. 4A) extends the plunger 219 from the end of the shaft extension 203 to an intermediate quick flush position as illustrated in FIG. 5D. Depressing the full flush button 216 (FIG. 4A) fully extends the plunger 219 from the end of the shaft extension 203 to a full flush position as illustrated in FIG. 5F.

Figure 5G:
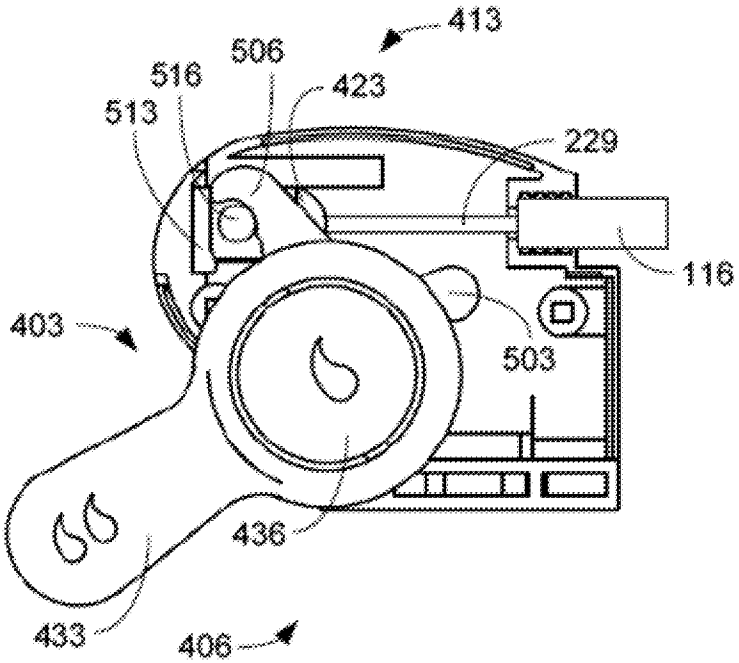

Counter clockwise rotation of the handle lever 433 produces a similar result. The torque transferred from the handle lever 433 to the dual-input cam 429 through shaft 443 and opening is exerted on the cable anchor 423, initially as a breakaway force and subsequently as a reduced translation force as described above. Depressing handle button 436 before rotating handle lever 433 restricts the rotation of the activation control assembly 403, to the intermediate quick flush position as illustrated in FIG. 5E. Rotating the handle lever 433 without depressing the handle button 436 initiates a full flush of the dual flush assembly 103 by allowing the handle lever 433 to be rotated in a counter clockwise direction beyond the quick flush restriction point. FIG. 5G illustrates the handle lever 433 rotated to the full flush position.

Referring next to FIGS. 6A-6D, shown is one example of a dual flush handle assembly 600 according to various embodiments of the present disclosure. The dual flush handle assembly 600 may be used to initiate a partial flush and/or a full flush of a toilet. To this end, the dual flush handle assembly 600 may be in communication with, for example, the actuation control box 313 (FIG. 3), the dual-input activation assembly 406 (FIGS. 4A-4F), or other dual flush activation control mechanisms. As further non-limiting examples, the dual flush handle assembly 600 may be used with various embodiments disclosed in co-pending U.S. patent application entitled "Dual Flush Activation" filed on Jan. 7, 2011 and assigned application Ser. No. 12/986,729, which is incorporated by reference herein in its entirety.

Figure 6A:
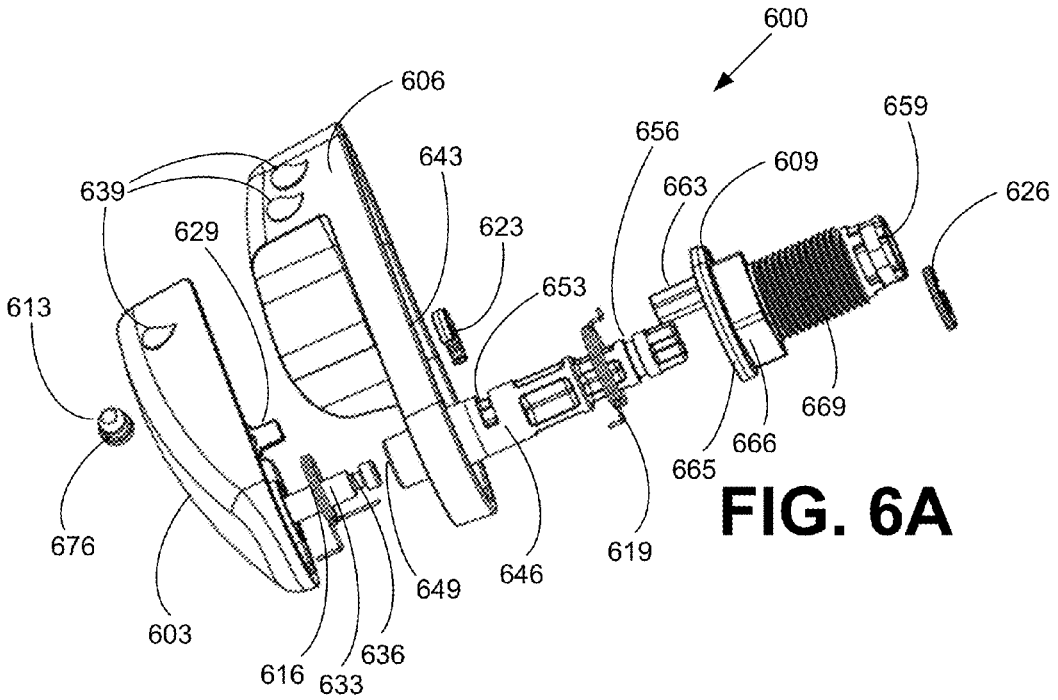
FIGS. 6A-6D are drawings that provide various views of an embodiment of a dual flush handle assembly that can be utilized in the activation assembly of FIGS. 3A-3G according to various embodiments of the disclosure.
Figure 6B:
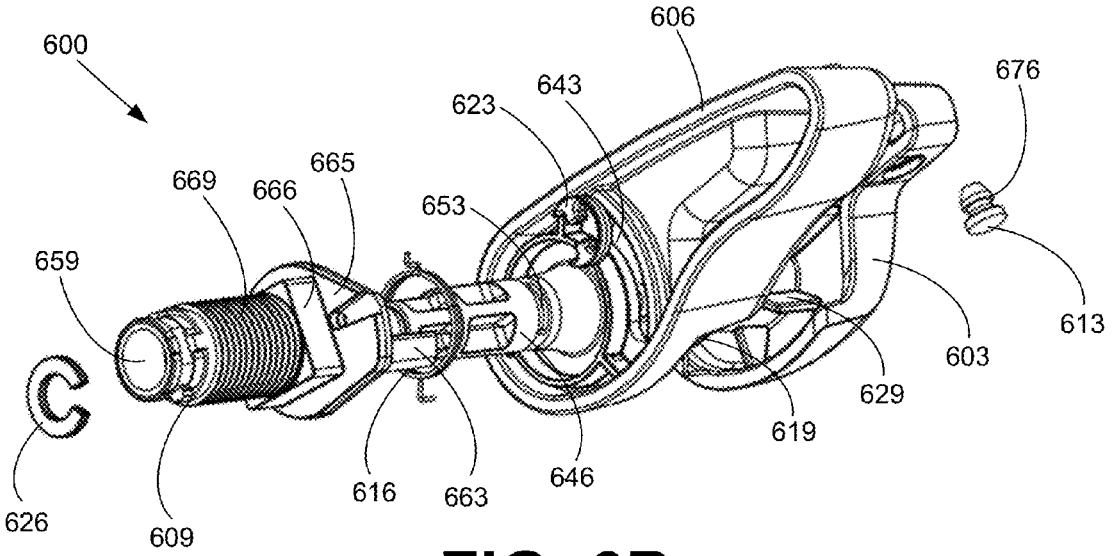

FIGS. 6A-6B show exploded views of one embodiment, among others, of the dual flush handle assembly 600. The dual flush handle assembly 600 includes a first handle lever 603, a second handle lever 606, a bushing 609, a damper 613, a first spring 616, a second spring 619, a first retaining element 623, a second retaining element 626, and possibly other components not discussed in detail herein.

The first handle lever 603 is shaped to be nested within the second handle lever 606. In this sense, the first handle lever 603 and second handle lever 606 are formed to facilitate at least a portion of the first handle lever 603 "fitting" within a portion of the second handle lever 606. The second handle lever 606 may fit within a profile of the first handle so as to promote the appearance of a single handle. Accordingly, the dual flush handle assembly 600 may present an appearance of a conventional toilet flush lever, while providing the functionality of a dual flush handle control.

As will later be described, the first handle lever 603 and second handle lever 606 may be configured to rotate coaxially about a common axis in order to initiate a partial flush and/or a full flush of a toilet. The first handle lever 603 may be limited in rotation by a certain amount. The second handle lever 606 may be limited in rotation by an amount that differs from the rotation of the first handle lever 603. In this sense, the rotation of the first handle lever 603 and rotation of the second handle lever 606 may overlap at least partially. Further, it is emphasized that initiating a partial flush or a full flush may be caused by rotating the first handle lever 603 or second handle lever 606, respectively, in the same direction of rotation.

The first handle lever 603 is configured to rotate about an axis by a predetermined angle of rotation. To this end, the first handle lever 603 includes a projection 629 and post 633, both extending from a toilet-facing surface of the first handle lever 603. In various embodiments, the projection 629 may comprise tabs, pins, knobs, detents, or other types of projections. The post 633 includes a post groove 636 to facilitate retaining the first handle lever 603 to the dual flush handle assembly 600 as will be later described. The first handle lever 603 may also include one or more indicators 639 to denote to a user that the function of the first handle lever 603 is to initiate a partial flush of a toilet.

The second handle lever 606 is also configured to rotate about an axis by a predetermined angle of rotation. It is emphasized that the second handle lever 606 may rotate by a predetermined angle of rotation that is different than the angle of rotation of the first handle lever 603. The second handle lever 606 includes a slot 643, a stem 646, one or more indicators 639, and possibly other features not discussed in detail herein.

Figure 6C:
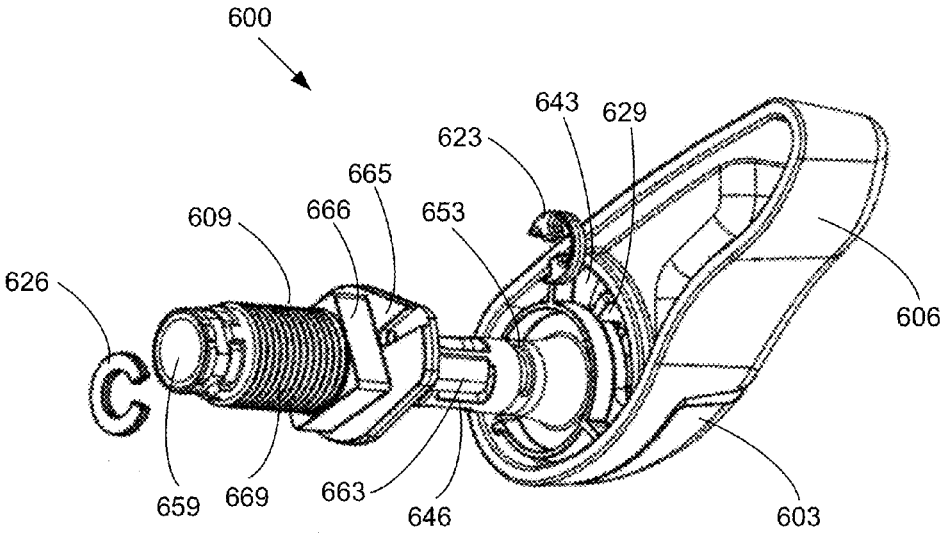
Figure 6D:
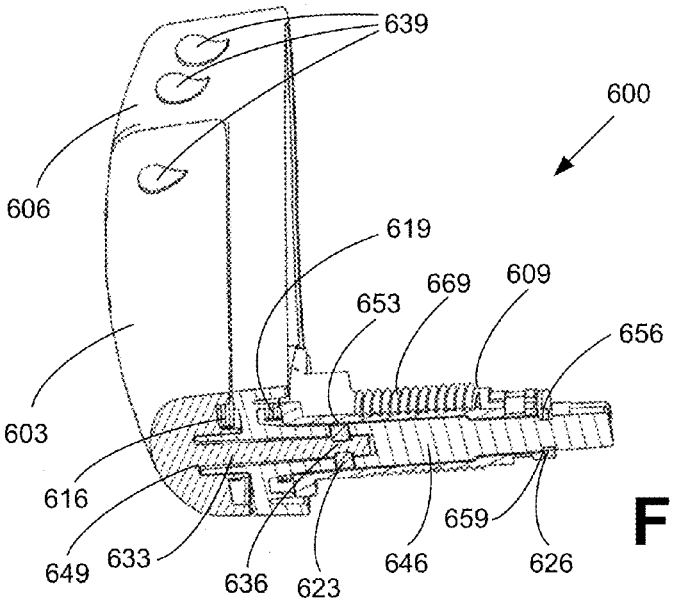

As best shown in FIGS. 6B and 6C, the slot 643 is disposed in a wall of the second handle lever 606 and is configured to receive the projection 629. The stem 646 extends from both the outward and toilet-facing surfaces of the second handle lever 606. In alternative embodiments, the stem 646 may extend from only one of the outward or toilet-facing surfaces of the second handle lever 606.

The stem 646 includes a bore 649 extending from the outward end of the stem 646. The bore 649 is configured to receive the post 633 of the first handle lever 603. Although the stem 646 shown in FIGS. 6A-6D is configured to receive the post 633, the post 633 in alternative embodiments may be configured to receive the stem 646.

The portion of the stem 646 extending from the interior end of the second handle lever 606 includes a stem slot 653 configured to accommodate the first retaining element 623. At the distal end of the interior portion of the stem 646 is a stem groove 656. The stem groove 656 is configured to receive the second retaining element 626 and facilitates securing the second handle lever 606 to the bushing 609.

The bushing 609 is configured to extend through an opening in a wall of a toilet tank. The bushing 609 includes a passage 659, a stop 663, a lip 665, a rectangular segment 666, a threaded segment 669, and possibly other features not discussed in detail herein.

The passage 659 extends longitudinally through the bushing 609 and is configured for the stem 646 of the second handle lever 606 to pass at least partially through the bushing 609. The stop 663 extends from the bushing 609 and is configured to extend through the slot 643 of the second handle lever 606 and to abut the projection 629 of the first handle lever 603 as will be later described.

The lip 665 of the bushing 609 is configured to abut an exterior surface of a toilet tank. The rectangular segment 666 is configured to be secured in a rectangular opening in the toilet tank wall, thereby preventing rotational movement of the bushing 609 with respect to the toilet tank wall. The threaded segment 669 of the bushing 609 is configured to receive an appropriately threaded nut that abuts an interior surface of the toilet tank wall, thereby preventing translational movement of the bushing 609 with respect to the toilet tank.

The damper 613 may be disposed between the first handle lever 603 and second handle lever 606. In the embodiment shown in FIGS. 6A-6D, the damper 613 is attached to the first handle lever 603. However, in alternative embodiments, the damper 613 may be attached to the second handle lever 606. Best shown in FIG. 6B, the damper includes a lip 676 to facilitate retaining the damper 613 in an appropriate aperture of the first handle lever 603. In alternative embodiments, the damper 613 may be attached using, for example, an adhesive or other attachment mechanism.

The damper 613 may be formed of various cushioning materials, such as rubber, nylon, foam, or other materials. By being disposed between the first handle lever 603 and second handle lever 606, the damper 613 may prevent or reduce sound caused by the first handle lever 603 abruptly contacting the second handle lever 606. Additionally, the damper 613 may provide a cushioned sensation when using dual flush handle assembly 600.

The first spring 616 may be configured to provide a bias force that retains the first handle lever 603 towards the second handle lever 606 when in a neutral position. To this end, the first spring 616 may be disposed between the first handle lever 603 and second handle lever 606, with the first spring 616 being around the post 633. The ends of the first spring 616 may be retained, for example, in appropriate openings in the first handle lever 603 and/or second handle lever 606 as is appreciated.

In other embodiments, the function of the first spring 616 may be incorporated into the damper 613. To this end, the damper 613 may be formed of a spring-like material and attached to the first handle lever 603 and second handle lever 606.

The second spring 619 is configured to provide a bias force that facilitates returning the second handle lever 606 and/or first handle lever 603 to a neutral position after initiating a flush. To this end, the second spring 619 may be disposed between the second handle lever 606 and bushing 609, with the second spring 619 being around the stem 646 of the second handle lever 606. The ends of the second spring 619 may be retained, for example, in appropriate holes in the second handle lever 606 and/or bushing 609.

The second spring 619 may also facilitate installation of the dual flush handle assembly 600. In this sense, the second spring 619 may bias the first handle lever 603 and second handle lever 606 to be in an approximately horizontal position when the bushing 609 is inserted into an opening in the toilet tank wall and prevented from rotating with respect to the tank wall. In other words, with the bushing 609 inserted into the tank wall and fixed from rotating, the second spring 619 may facilitate the first handle lever 603 and second handle lever 606 being biased in an approximately horizontal position.

Although the first spring 616 and second spring 619 are shown as being coil springs, other types of springs may be used in accordance with the present disclosure. For example, flat springs, leaf spring, rubber bands, or any other type of spring element may be used. Further, it is understood that a first spring 616 and/or second spring 619 may be omitted in various embodiments.

The first retaining element 623 is configured to retain the post 633 within the stem 646. To this end, the first retaining element 623 may insert at least partially into the stem slot 653 and clip to the post groove 636. Thus, the first retaining element 623 may retain the first handle lever 603 to the second handle lever 606 in a lateral position, while facilitating rotation of the first handle lever 603 with respect to the second handle lever 606.

In a similar fashion, the second retaining element 626 is configured to retain the stem 646 within the bushing 609. To this end, with the stem groove 656 extending through the passage 659 of the bushing 609, the second retaining element 626 may clip to the stem groove 656. Thus, the second retaining element 626 may retain the second handle lever 606 to the bushing 609 in a lateral position, while facilitating rotation of the second handle lever 606 and/or first handle lever 603 with respect to the bushing 609.

It is understood that other methods of retaining the first handle lever 603, second handle lever 606, and bushing 609 may be used. For example, instead of the stem 646 extending from the second handle lever 606, the stem 646 may extend from the bushing 609. In such a case, the second handle lever 606 and/or first handle lever 603 may include appropriate mechanisms for attachment as can be appreciated.

In addition, it is understood that other mechanisms of restricting the rotation of the first handle lever 603 and/or second handle lever 606 may be used. For example, although embodiment of FIGS. 6A-6D shows the first handle lever 603 comprising the projection 629 and the second handle lever 606 comprising the slot 643, the second handle lever 606 may comprise a projection 629 in various alternative embodiments. Additionally, the projection 629 may extend from the bushing 609 in various other embodiments. Even further, the first handle lever 603 and/or bushing 609 may comprise the slot 643.

Next, a description of the general operation of the dual flush handle assembly 600 is provided. FIGS. 7A-7C, 8A-8C, and 9A-9C show progressions of the dual flush handle assembly 600 being in a neutral position, initiating a partial flush (i.e., "quick flush"), and initiating a full flush, respectively.

Figure 7A:
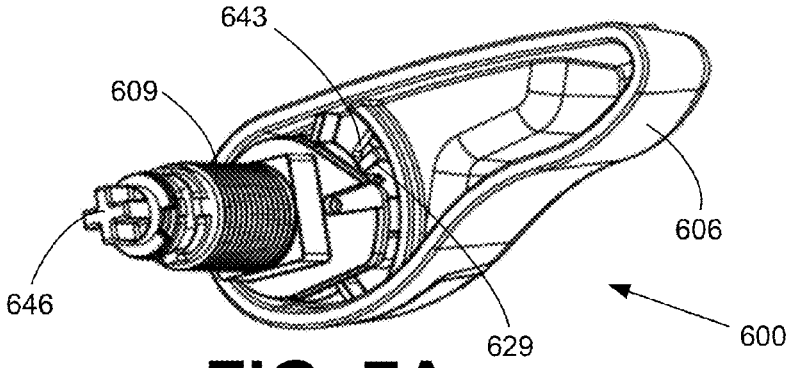
FIGS. 7A-7C are drawings that provide various views of the dual flush handle assembly of FIGS. 6A-6D in a neutral position.
Figure 7B:
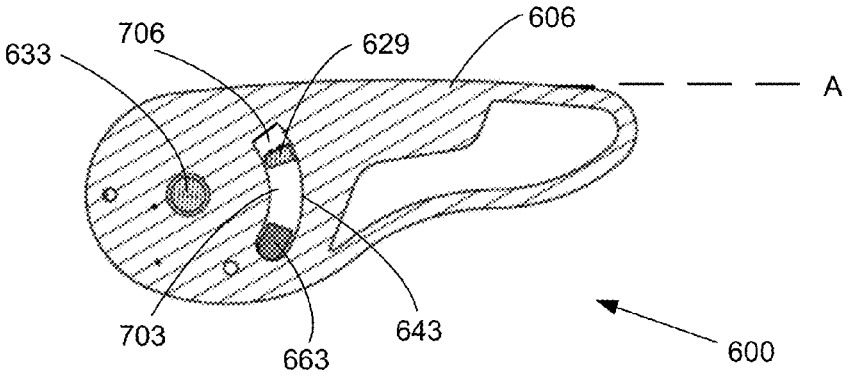
Figure 7C:
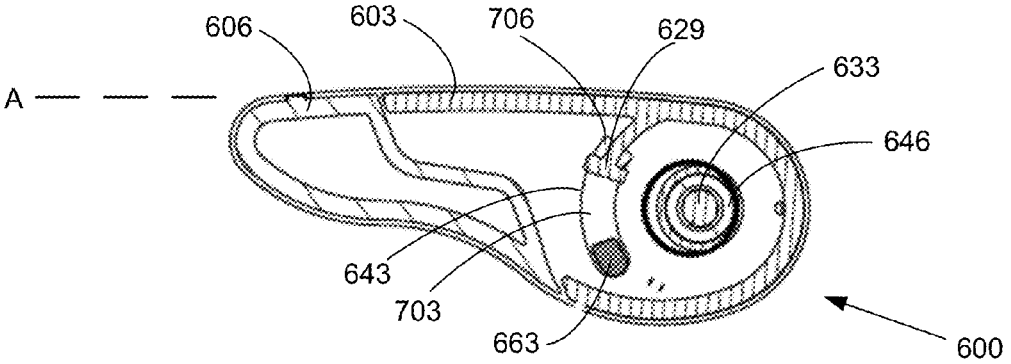

With reference to FIGS. 7A-7C, shown is the dual flush handle assembly 600 in a neutral position according to various embodiments of the present disclosure. The neutral position shown is the position to which the dual flush handle assembly 600 returns after a flush has been initiated. As shown in FIGS. 7B and 7C, the reference line A denotes the position at which a portion of the first handle lever 603 and second handle lever 606 rest while in the neutral position.

As shown in FIGS. 7A-7C, the projection 629 of the first handle lever 603 (FIGS. 6A-6D) is positioned within the slot 643 of the second handle lever 606. Also, the stop 663 of the bushing 609 is positioned within the slot 643 of the second handle lever 606. As best shown in FIGS. 7B and 7C, there is a space 703 between the stop 663 and the projection 629. Further, there is a space 706 between the projection 629 and an edge of the slot 643. Additionally, the stop 663 of the bushing 609 is engaged with the opposite edge of the slot 643.

Figure 8A:
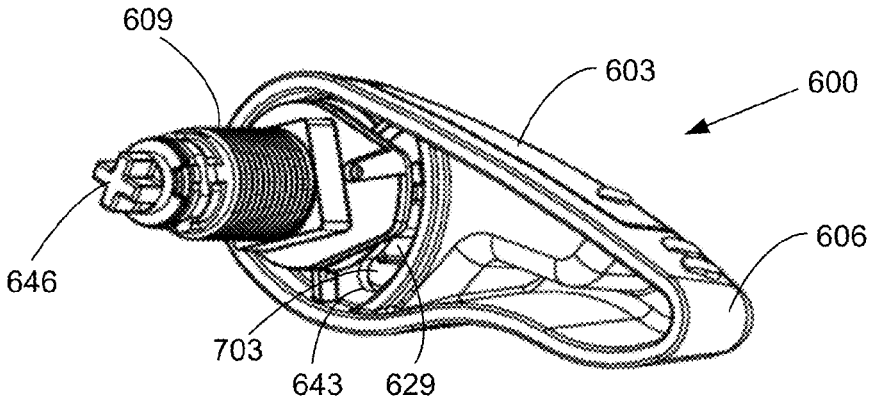
FIGS. 8A-8C are drawings that provide various views of the dual flush handle assembly of FIGS. 6A-6D in a position configured to initiate a partial flush in a toilet.
Figure 8B:
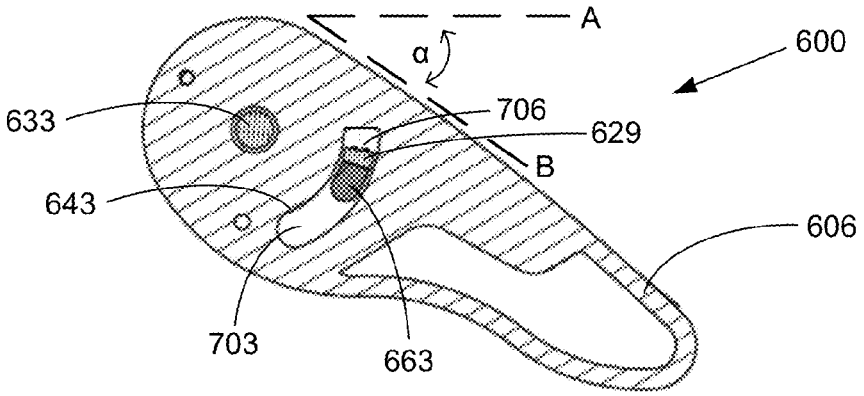
Figure 8C:
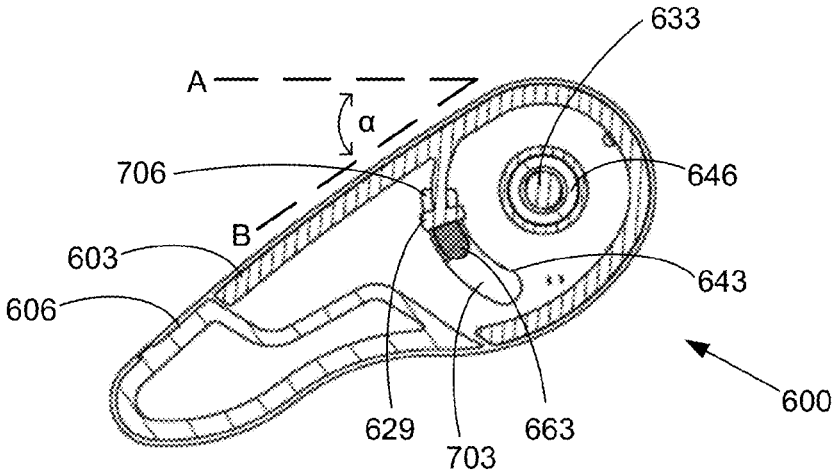

Turning now to FIGS. 8A-8C, shown is the dual flush handle assembly 600 in a position configured to initiate a partial flush of a toilet. The dual flush handle assembly 600 may arrive in this position, for example, by a user pressing on the first handle lever 603. Rotating the first handle lever 603 pushes against the second handle lever 606 causing the second handle lever 606, and thus the stem 646, to rotate as well. The rotation of the first handle lever 603 is limited by the projection 629 of the first handle lever 603 making contact with the stop 663 of the bushing 609. By rotating the first handle lever 603 by the predetermined amount, the stem 646 rotates to initiate a partial flush, for example, through the actuation control box 313 (FIGS. 3A-3G) as described above.

As shown in FIGS. 8B and 8C, the angle $\alpha$ denotes the angle of rotation that the first handle lever 603 and second handle lever 606 have rotated from the neutral position (denoted by reference line A) to the position for initiating a partial flush (denoted by reference line B). By rotating by the angle $\alpha$, the stop 663 now abuts the projection 629 of the first handle lever 603. Thus, the angle of rotation a is limited by the projection 629 engaging the stop 663. With the projection 629 engaging the stop 663, there is a space 703 between the stop 663 and an edge of the slot 643. Additionally, the space 706 between the projection 629 and opposite end of the slot 643 still exists.

After a partial flush has been initiated, the dual flush handle assembly 600 may automatically return to the neutral position shown in FIGS. 7A-7C. To this, end, the second spring 619 or any other mechanism may cause the dual flush handle assembly 600 to return to the neutral position.

Figure 9A:
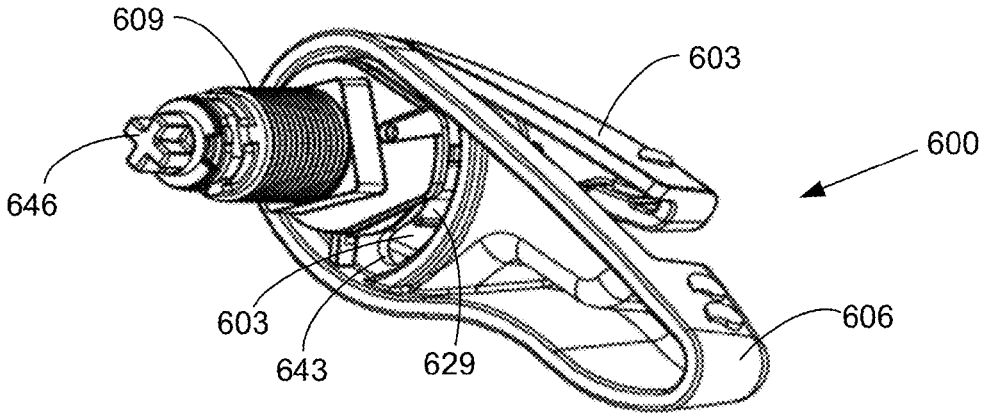
FIGS. 9A-9C are drawings that provide various views of the dual flush handle assembly of FIGS. 6A-6D in a position configured to initiate a full flush in a toilet.
Figure 9B:
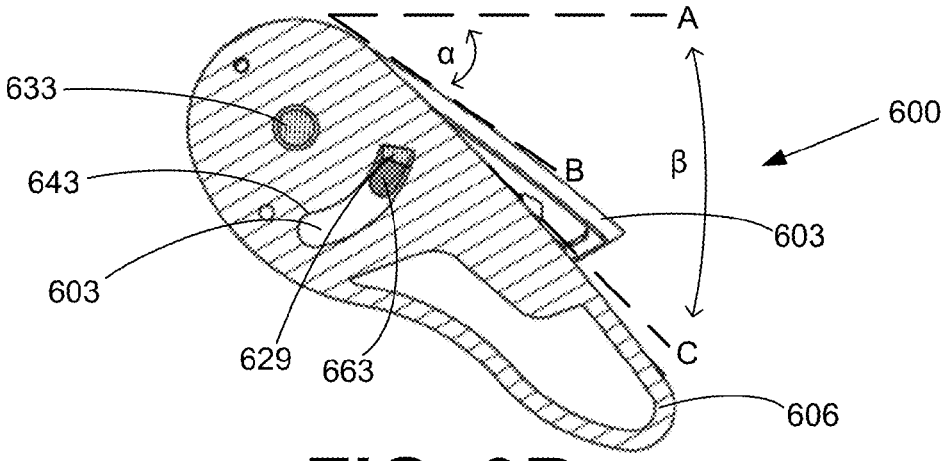
Figure 9C:
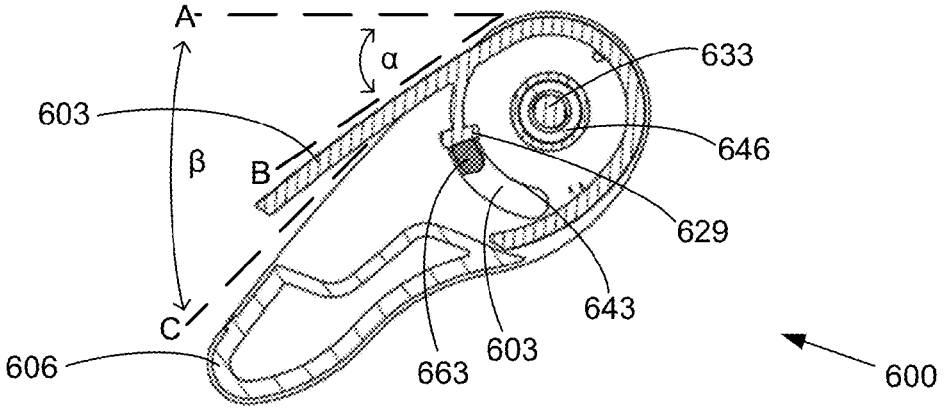

Turning to FIGS. 9A-9C, shown is the dual flush handle assembly 600 in a position configured to initiate a full flush of a toilet. The dual flush handle assembly 600 may arrive in this position, for example, by a user pressing the second handle lever 606. By pressing on the second handle lever 606, the first spring 616 (FIGS. 6A-6D) cause the first handle lever 603 to rotate in conjunction with the second handle lever 606 by angle α until the projection 629 of the first handle lever 603 contacts the stop 663 of the bushing 609. While the first handle lever 603 stops rotating at angle α, the second handle lever 606 may continue to rotate until the edge of the slot 643 of the second handle lever 606 contacts the tab of the first handle lever 603. Thus, the stem 646 may rotate to initiate a full flush of a toilet, for example, via the actuation control box 313 (FIGS. 3A-3G).

As shown in FIGS. 9B and 9C, the angle α denotes the angle of rotation that the first handle lever 603 has rotated from the neutral position (denoted by reference line A). Similarly, the angle β shows the angle of rotation that the second handle lever 606 has rotated from the neutral position (denoted by reference line A) to the full flush position (denoted by reference line C).

As best shown in FIGS. 9B and 9C, the stop 663 abuts the projection 629, and the projection 629 engages the edge of the slot 643 of the second handle lever 606. Thus, the slot 643 in conjunction with the projection 629 acts to define the predetermined angle β of rotation. With the dual flush handle assembly 600 in the position configured to initiate a full flush, the space 706 (FIG. 8A-8C) between the projection 629 and edge of the slot 643 no longer exists. Additionally, the space 703 between the stop 663 and opposite edge of the slot 643 has widened.

After a full flush has been initiated, the dual flush handle assembly 600 may automatically return to the neutral position shown in FIGS. 7A-7C. To this end, the second spring 619 or any other mechanism may return the dual flush handle assembly 600 to the neutral position. In alternative embodiments, the dual flush handle assembly 600 may return to the neutral position using other mechanisms. As non-limiting examples, the dual flush handle assembly 600 may return to the neutral position due its own weight, from a flush valve dropping due to a drop in water level in the toilet tank, from a spring force inside the activation control box 313 (FIG. 3), from a spring force associated with a flush valve, or from any other mechanism.

It is noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

a first handle lever configured to rotate in a direction about an axis, the first handle lever comprising a projection extending from an interior side of the first handle lever;

a second handle lever configured to rotate in the direction about the axis, the second handle lever comprising a slot, wherein the projection extends at least partially through the slot; and a stop extending through the slot, wherein the stop is configured to engage the projection of the first handle lever upon rotating the first handle lever by an angle of rotation.

2. The apparatus of claim 1, wherein the angle of rotation further comprises a first angle of rotation, and the projection of the first handle lever is configured to engage an edge of the slot upon rotating the second handle lever by a second angle of rotation.

3. The apparatus of claim 1, further comprising a damper disposed between the first handle lever and the second handle lever.

4. The apparatus of claim 1, wherein at least a portion of the first handle lever is nested in at least a portion of the second handle lever.

5. The apparatus of claim 1, wherein:

the second handle lever further comprises a stem extending from the interior side of the second handle lever; and the first handle lever further comprises a post extending from an interior wall of the first handle lever into the stem of the first handle lever.

6. The apparatus of claim 5, wherein the stem further comprises a groove configured to receive a retaining element.

7. The apparatus of claim 1, wherein:

the second handle lever further comprises a stem extending from the interior side of the second handle lever; and the stem is retained in a bushing configured to extend through a wall of a toilet tank.

8. The apparatus of claim 7, wherein the bushing further comprises a groove configured to receive a retaining element.

9. The apparatus of claim 1, further comprising a spring configured to return the first handle lever and the second handle lever to a neutral position after a flush activation.

10. The apparatus of claim 1, further comprising a spring configured to rotate the first handle lever towards the second handle lever.

11. A dual flush toilet handle system, comprising:

a first handle lever configured to rotate in a direction by a first predetermined angle of rotation to initiate a first flush; and a second handle lever configured to rotate in the direction by a second predetermined angle of rotation to initiate a second flush, wherein at least a portion of the first handle lever is nested in at least a portion of the second handle lever.

12. The dual flush toilet handle system of claim 11, wherein at least a portion of the first predetermined angle of rotation overlaps with at least a portion of the second predetermined angle of rotation.

13. The dual flush toilet handle system of claim 11, wherein the first handle lever and the second handle lever rotate about a common axis.

14. The dual flush toilet handle system of claim 11, further comprising a damper disposed between the first handle lever and the second handle lever.

15. The dual flush toilet handle system of claim 14, wherein the damper further comprises a lip configured to retain the damper in an aperture of the first handle lever.

16. The dual flush toilet handle system of claim 14, wherein the damper further comprises a lip configured to retain the damper in an aperture of the second handle lever.

17. The dual flush toilet handle system of claim 11, wherein:

the second handle lever further comprises a slot;

the first handle lever further comprises a projection extending at least partially through the slot; and a stop extends at least partially through the slot.

18. The dual flush toilet handle system of claim 11, wherein the first handle lever further comprises a post extending at least partially through the second handle lever.

19. The dual flush toilet handle system of claim 18, wherein:

the second handle lever further comprises a stem; and the post is retained in the stem.

20. The dual flush toilet handle system of claim 11, wherein:

the second handle lever further comprises a stem; and the stem is retained in a bushing configured to extend through a wall of a toilet tank.

21. An apparatus, comprising:

a first handle lever configured to rotate by a first predetermined angle of rotation to initiate a first flush of a toilet;

a second handle lever configured to rotate by a second predetermined angle of rotation to initiate a second flush of the toilet; and means for rotating the first handle lever and the second handle lever about a common axis.

22. The apparatus of claim 21, further comprising means for absorbing a contact force between the first handle lever and the second handle lever.

23. The apparatus of claim 21, wherein at least a portion of the first handle lever is nested within at least a portion of the second handle lever.

24. The apparatus of claim 21, further comprising:

a first flush mode indicator disposed on the first handle lever; and a second flush mode indicator disposed on the second handle lever;

wherein the first flush mode indicator differs from the second flush mode indicator.

25. The apparatus of claim 21, further comprising means for returning the first handle lever and the second handle lever to a neutral position after a flush activation.

26. The apparatus of claim 21, further comprising means for rotating the first handle lever in a direction towards the second handle lever.

27. A method, comprising the steps of:

nesting a first handle lever in a second handle lever at a neutral position;

rotating, about an axis, the first handle lever in a direction by a first predetermined angle of rotation to initiate a partial flush in a toilet; and rotating, about the axis, the second handle lever in the direction by a second predetermined angle of rotation to initiate a full flush in the toilet.

28. The method of claim 27, further comprising the step of automatically returning the first handle lever to a nested neutral position.

29. The method of claim 27, further comprising the step of automatically returning the second handle lever to a nested neutral position.

* * * * *